US005603176A

United States Patent [19]

Eddins et al.

[11] Patent Number: 5,603,176

[45] Date of Patent: Feb. 18, 1997

[54] SIMULATED SUSPENDED ANIMATION BIOSPHERE

[75] Inventors: Fred D. Eddins, Mapleville; Linwood E. Doane, Jr., Cumberland, both of R.I.

[73] Assignee: Hasbro, Inc., Pawtucket, R.I.

[21] Appl. No.: 395,226

[22] Filed: Feb. 27, 1995

[51] Int. Cl.[6] ..... G09F 19/00

[52] U.S. Cl. ..... 40/409; 40/406; 446/267; 428/13

[58] Field of Search ..... 40/406, 409, 410; 446/267; 428/13, 16

[56] References Cited

U.S. PATENT DOCUMENTS

| | | | |
|---|---|---|---|
| D. 179,853 | 3/1957 | Kelly . | |
| D. 287,347 | 12/1986 | Grun . | |
| D. 327,233 | 6/1992 | McClellan . | |
| D. 336,061 | 6/1993 | Kraselsky et al. . | |
| 2,773,175 | 12/1956 | Levy et al. . | |
| 3,638,709 | 2/1972 | Brown, Jr. et al. | 156/57 |
| 3,886,248 | 5/1975 | Nicholson | 428/13 X |
| 4,582,498 | 4/1986 | Tamada . | |
| 5,329,714 | 7/1994 | Lee | 40/409 |

OTHER PUBLICATIONS

Laponite Brochure, Laporte Industries Ltd.

*Primary Examiner*—Brian K. Green

[57] ABSTRACT

A simulated suspended animation biosphere assembly includes an outer housing having a transparent wall portion, a transparent gel in the housing and at least one action component movably suspended in the gel. The action component is adapted to resemble an actual action element which is capable of voluntary controlled independent action movement and which is movably suspendable in a natural environmental medium.

7 Claims, 4 Drawing Sheets

SIMULATED SUSPENDED ANIMATION BIOSPHERE

BACKGROUND OF THE INVENTION

The instant invention relates to novelty items and more particularly to a simulated suspended animation biosphere assembly which is adapted to be readily assembled and later rearranged by a user to provide a realistic and readily changeable biosphere-type display.

Biosphere assemblies, such as aquariums and terrariums, have generally been found to have significant levels of appeal. Artificial biosphere assemblies, such as artificial aquariums containing artificial fish and/or plants, have also been found to have high levels of appeal, although, for the most part, artificial biosphere assemblies have been found to have significantly less appeal than actual aquariums and the like containing actual living plant life and/or fish. Although the reduced appeal for artificial aquariums and the like has generally resulted from the fact that actual living fish and plants are generally more interesting for observers to view than artificial fish and plant life, it is also partly because most artificial aquariums and the like are not adapted to permit users to rearrange or reassemble components in suspended animation therein. For example, artificial aquariums containing water as an environmental medium generally do not permit items, such as artificial fish, to be suspended in stationary relation therein, and artificial aquariums containing simulated environmental media made from solid materials, such as transparent plastic materials, generally do not permit users to rearrange items, such as artificial fish and the like, therein. Nevertheless, artificial biosphere assemblies containing water and/or solid materials as environmental media have maintained a significant level of popularity as a result of being essentially maintenance free biospheric units. Examples of previously available biospheric assemblies of these types are disclosed in the U.S. Pat. Nos. to Levy et al., 2,773,175; Kelly, 179,853; Tamada, 4,582,498; Grun, 287, 347; McClellan, 327,233; and Kraselsky et al., 336,061. However, since these biosphere assemblies either comprise water, air, or a solid transparent material as an environmental medium, they are not adapted to permit elements, such as artificial fish and the like, to be movably suspended therein.

SUMMARY OF THE INVENTION

The instant invention provides a unique confined biosphere assembly which is adapted to permit various items, such as artificial fish and the like, to be indefinitely maintained in suspended animation in a transparent environmental medium and to nevertheless permit the items to be repositioned in the environmental medium at will. Accordingly, the simulated confined biosphere assembly of the instant invention is adapted to permit a user to assemble various items therein so that they appear to be suspended in space, but so that they cam nevertheless be repositioned as desired.

The simulated confined suspended animation biosphere assembly of the instant invention comprises an outer housing defining a confined interior area therein including a transparent side wall portion for viewing said interior area and a transparent liquid gel in the interior area for simulating an environmental medium therein. The biosphere assembly further comprises at least one suspendable action component which is movably suspended in the gel in a stationary disposition, but nevertheless movable therein. The action component is adapted to resemble an actual action element which is capable of voluntary controlled independent action movement, and the gel and the action component are adapted to permit the action component to be indefinitely suspended in a stationary disposition in the gel without floating upwardly or gravitating downwardly therein. The gel comprises a transparent inorganic clay colloidal dispersion preferably comprising a synthetic smectite clay dispersion in water. The gel is preferably colorless, and it preferably contains imidazolidinyl urea as a preservative. The gel preferably comprises between approximately 1.5 percent and 4 percent by weight of synthetic smectite clay and between approximately 0.05 and 0.5 wt. % of imidazolidinyl urea preservative. A suitable synthetic smectite clay for forming the gel is readily available from Laporte Industries Ltd., Cheshire, England, under the Trademark Laponite.

The method of the instant invention, on the other hand, comprises the steps of assembling a transparent liquid gel in a confined interior area of an at least partially transparent housing and assembling a suspendable action component of the above-described type in the gel so that the action component is movably suspended therein. The action component and the gel are adapted to permit the action component to be indefinitely movably suspended in a stationary disposition in the gel without floating upwardly or gravitating downwardly therein, and the gel preferably comprises an inorganic clay colloidal dispersion in water. More specifically, the gel preferably comprises an inorganic dispersion of synthetic smectite clay, and it preferably further comprises an imidazolidinyl urea preservative. The suspendable component in one embodiment comprises a simulated aquatic suspendable component, and in this embodiment the method further comprises forming a series of bubbles in the gel leading from the suspendable component.

It has been found that the simulated confined suspended animation biosphere assembly and method of the instant invention are adapted to effectively provide highly interesting and amusing suspended animation biosphere units of a variety of different types. For example, when the biosphere assembly is adapted to simulate a suspended animation aquatic environment, the action component preferably comprises a fish, a submarine, or a diver which is movably suspended in the gel so that it is otherwise unsupported therein. The suspended animation biosphere assembly is also adapted to be alternatively embodied in a variety of other configurations, such as those in which the gel represents a nonaquatic environmental medium, such as a predominantly air atmospheric medium or an outer space environmental medium. In these embodiments the action component can be adapted to resemble an airplane, a skydiver, a space ship, or an astronaut, etc. In each embodiment, however, the action component is adapted to resemble an actual action element which is capable of voluntary controlled independent action movement and which is normally movably suspended in a natural environmental medium.

Accordingly, it is a primary object of the instant invention to provide an effective simulated confined suspended animation biosphere assembly which is adapted to permit a user to reposition a suspended action component therein.

Another object of the instant invention is to provide a simulated confined suspended animation biosphere assembly containing an environmental medium in which action components are movably suspended.

Another object of the instant invention is to provide a simulated confined suspended animation biosphere assembly which includes a simulated environmental medium comprising a synthetic smectite clay colloidal dispersion in water.

Another object of the instant invention is to provide a method of forming a realistic confined suspended animation biosphere assembly comprising an environmental medium in which one or more action components are movably suspended.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

DESCRIPTION OF THE PREFERRED EMBODIMENTS

Figure 1:
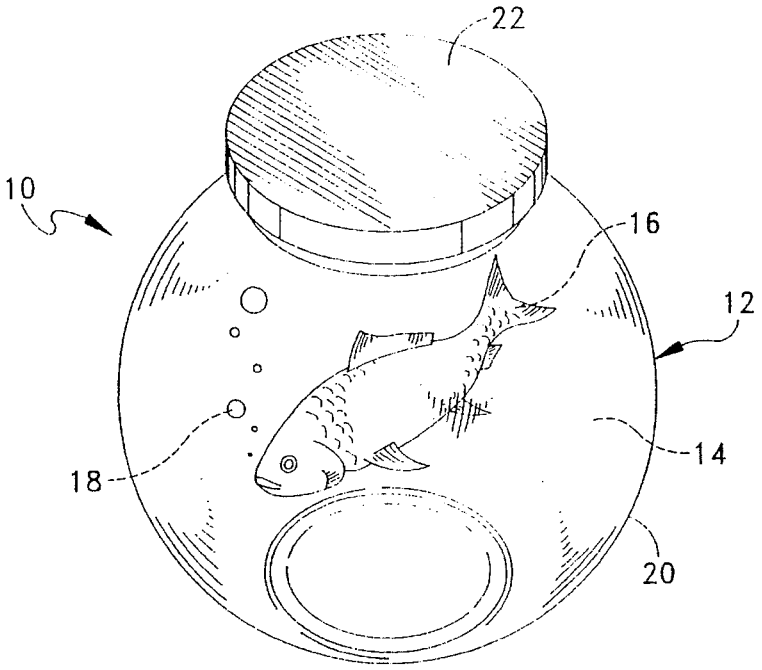
FIG. 1 is a perspective view of the simulated confined suspended animation biosphere assembly of the instant invention.
Figure 2:
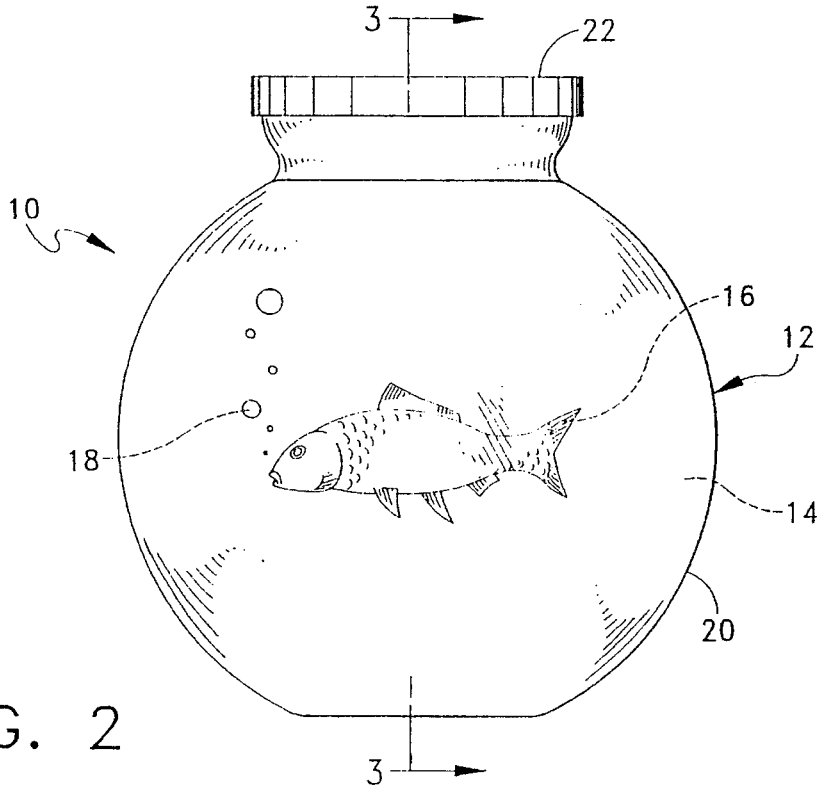
FIG. 2 is a front elevational view thereof.
Figure 3:
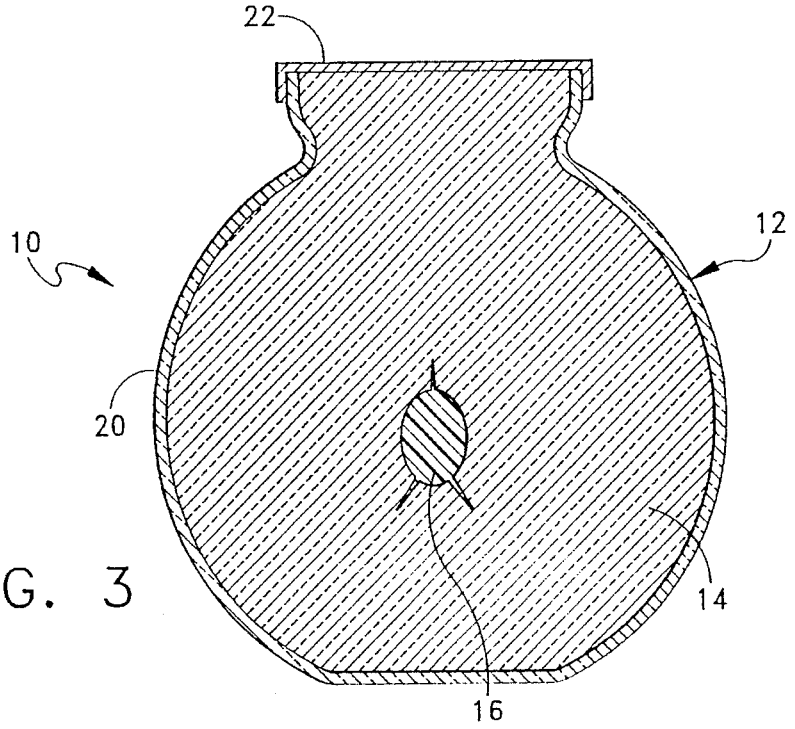
FIG. 3 is a sectional view taken along line 3—3 in FIG. 2.
Figure 4:
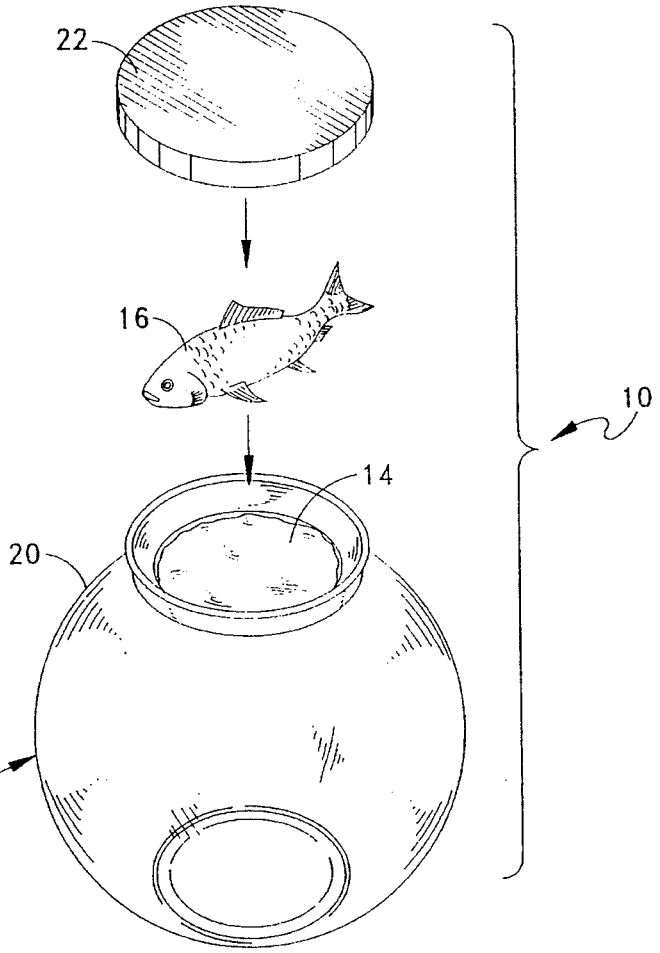
FIG. 4 is a partially exploded perspective view thereof.
Figure 5:
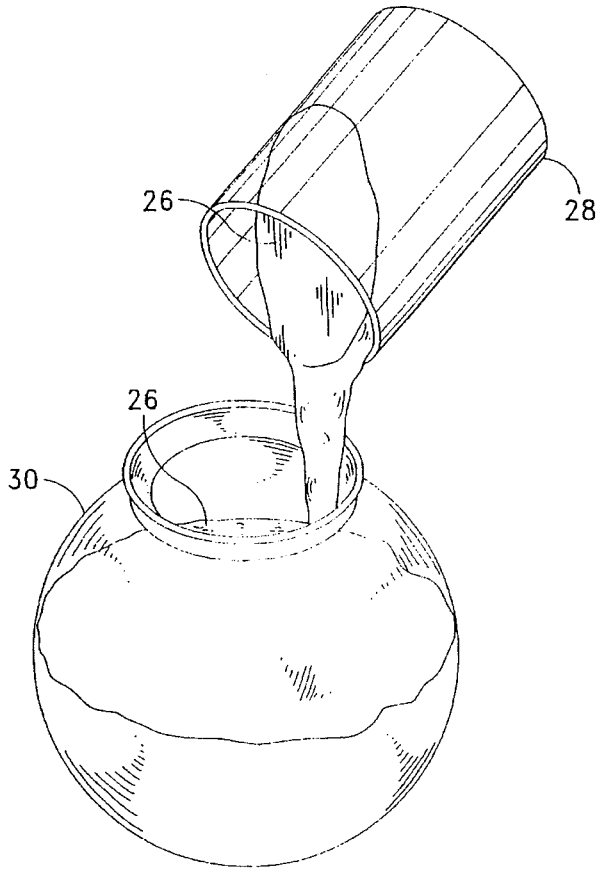
FIGS. 5–8 are sequential perspective views illustrating the method of the instant invention as used in forming a second embodiment of the biosphere assembly.
Figure 6:
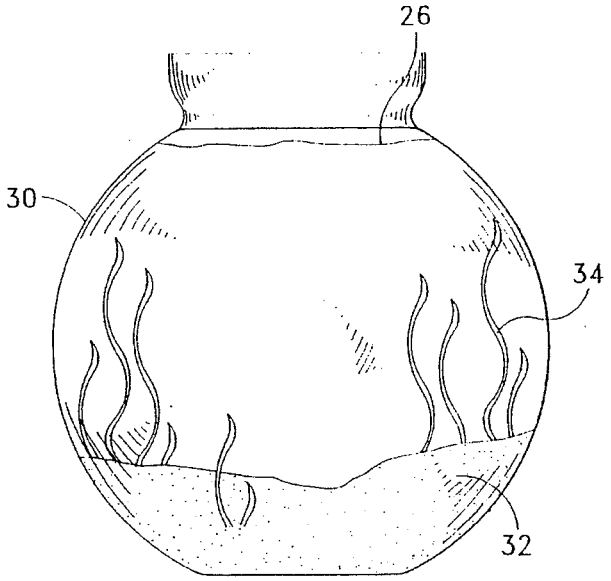
Figure 7:
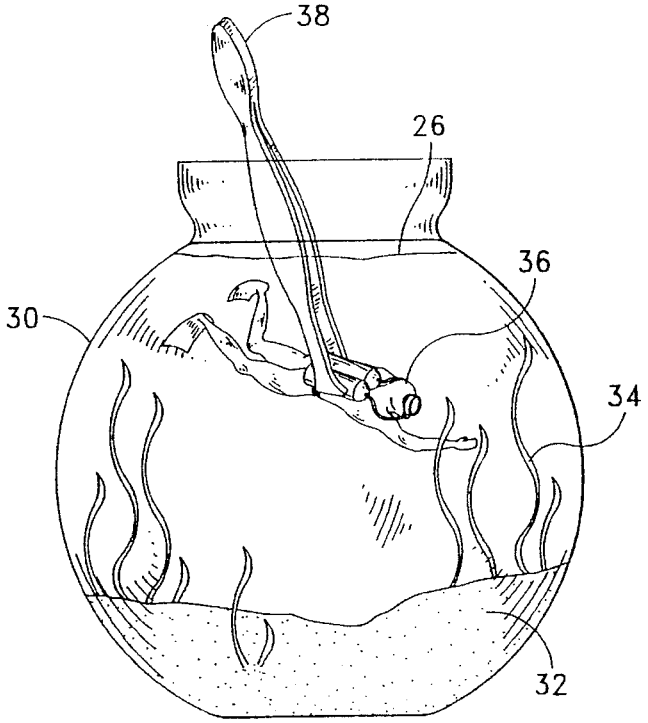

Referring now to the drawings, a first embodiment of the biosphere assembly of the instant invention is illustrated in FIGS. 1 through 4 and generally indicated at 10. The apparatus 10 comprises a housing generally indicated at 12, an environmental medium 14, and an action component 16 which is movably suspended in a stationary disposition in the environmental medium 14. The biosphere assembly 10 as here embodied further comprises a plurality of air bubbles 18 which are also movably suspended in stationary dispositions in the environmental medium 14. Accordingly, the biosphere assembly 10 is adapted to provide a simulated moving environmental unit in which the action element 16 is suspended in an environment which corresponds to an actual environment surrounding a living action element corresponding to the action element 16.

The outer housing 12 as herein embodied comprises a spherical glass aquarium unit 20 having a cover or lid 22. It will be understood, however, that the main purpose of the housing 12 is to provide a container for the medium 14, and that, therefore, the housing 12 could alternatively be embodied in a variety of other configurations which include transparent sidewall portions for viewing interior areas thereof.

The environmental medium 14 comprises a transparent gel which is adapted for movably suspending the action component 16 therein. The gel comprising the medium 1.4 preferably comprises a synthetic inorganic smectite clay colloidal dispersion in water. The smectite clay dispersion is preferably formulated so as to include between 0.5 wt. % and 4.0 wt. % of smectite clay in water. The gel preferably further comprises between 0.05 and 0.5 wt. % of imidazolidinyl urea preservative. In this regard, it has been found that, although the smectite clay colloidal dispersion utilized for the environmental medium does not readily support the growth of various micro organisms, such as algae and various bacteria, contaminants from other sources make it important to include a preservative therein which is capable of retarding or eliminating the growth of such micro organisms. This is because even seemingly insignificant human contact with the gel can be sufficient to introduce micro organisms thereinto which are capable of rapid growth which can cause the gel to rapidly become cloudy. Therefore, in order for a synthetic smectite clay colloidal dispersion to be effectively utilized for the gel in a manner which allows a user to rearrange the action component 16 therein, it is virtually essential for the gel to include a preservative. However, because the gel normally has a pH of between 8 and 9, many preservatives, at least those which are nontoxic, are ineffective for use in combination therewith. Also, since the preservative must not be toxic, must not contain heavy metals, and must come in powdered form, it has now been found that, in actual practice, imidazolidinyl urea is the only preservative which can be used effectively in the gel medium 14 for preventing micro organism growth.

As previously noted, the gel comprising the medium 14 further comprises synthetic smectite clay colloidal dispersion in water. In this regard, in order to provide an effective medium, the smectite clay colloidal dispersion must be substantially clear and colorless for most applications. As a result, it has been found that a synthetic smectite clay colloidal dispersion is preferable to a natural smectite clay colloidal dispersion which would inherently include insoluble minerals which cloud the medium 14. It has also been found that it is preferable to use distilled water when formulating the dispersion in order to avoid cloudiness and/or flocculation of the gel resulting from excessive calcium and/or other undesirable minerals in the water. It has, however, been found that trace quantities of an electrolyte, such as sodium chloride salt must be present in the water used for the gel in order to develop a satisfactory dispersion, although even the quantity of sodium chloride salt must be kept to a minimum in order to avoid cloudiness. In this regard, it has been found that when imidazolidinyl urea preservative is used in the gel, it is possible to reduce the amount of sodium chloride salt in the water used for the gel to only a trace quantity, and that this enhances the clarity of the gel. It should also be recognized that, although for most applications a colorless gel is preferable, in some instances it may be desirable to add a small quantity of nontoxic colored dye to the gel to achieve a desired visual effect. It should also be recognized that although the gel comprising the medium 14 normally remains in a gel consistency indefinitely, it is preferable to rearrange the action component within the first two or three weeks after forming the gel. This is because the gel has a tendency to become somewhat rubbery after several weeks, making it somewhat more difficult to reposition the component 16 therein.

The action component 16 is adapted to resemble an actual action element which is capable of voluntary controlled independent action movement and which is movably suspendable in a natural environmental medium. For example, the action element 16, which is herein embodied as a fish, could alternatively be embodied as a diver or a submarine which is movably suspendable in a natural aquatic environmental medium. Still further, the action component could be embodied as a skydiver, an airplane, a space ship, or an astronaut which is movably suspended in a nonaquatic environmental medium.

The air bubbles 18 are preferably introduced into the gel with an eye dropper or a similar syringe to enhance the visual effect produced by the assembly 10. Obviously, various patterns of bubbles 18 can be formed in the medium 14 to achieve various desired visual effects depending on the nature of the biosphere assembly 10, and in particular the action component 16.

Figure 8:
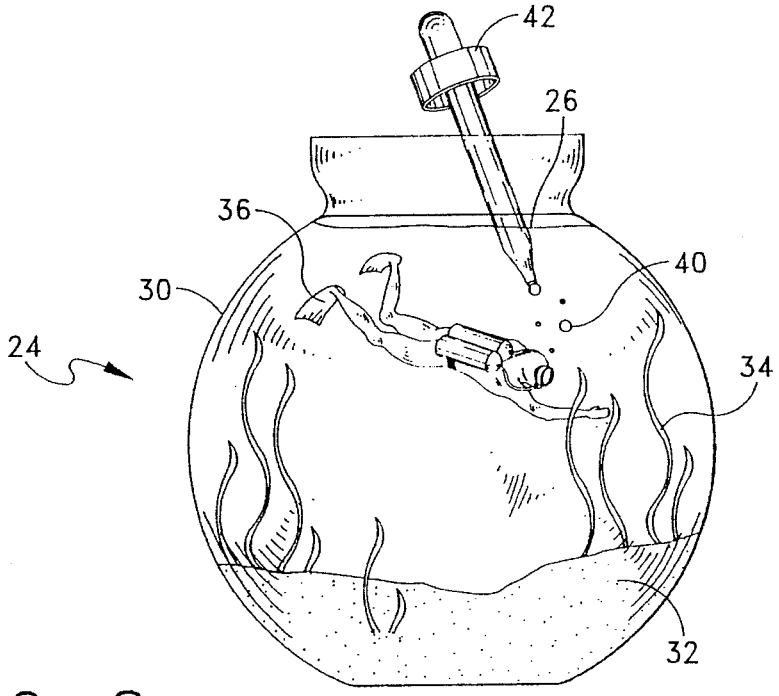

Referring now to FIGS. 5 through 8, the method of the instant invention as it is applied to the formation of a second biosphere assembly 24 is illustrated. In the first step of the method a quantity of gel 26, which has been prepared in accordance with the formulations hereinabove set forth, is poured from a container 28 into an outer housing 30 while the gel 26 is still in a relatively liquid state. In this regard, when the properly formulated artificial smectite clay is initially added to water to prepare the gel, the resulting mixture normally remains in a liquid state for 20–30 minutes, and therefore, the gel mixture 26 can be poured into the housing 30 during this time period. Once the gel 26 has been poured into the housing 30, a quantity of gravel 32 and various artificial aquatic plants 34 can be added to the gel 26. Components, such as the gravel 32, are preferably also added to the gel 26 while the gel 26 is in a relatively liquid state or even before the gel 26 is added to the housing 30, since the particular nature of the gravel 32 makes it impractical to reposition it in the gel 26 once the gel 26 has formed to a partially solidified gel consistency. However, once the gel 26 has been fully cured to a partially solidified gel consistency, it is possible to add an action component 36 thereto in the manner illustrated in FIG. 7. Specifically, the action component 36 is preferably added using a pair of forceps or tweezers 38, and because at this point the gel has partially solidified into a gel state, the action component 36 can be easily movably suspended in a stationary disposition therein so that it can effectively simulate an actual action element which is movably suspended in a natural environmental medium. Further, once the gel 26 has cured, it is also possible to "draw" three-dimensional objects therein using an eye dropper or a syringe to dispense various conventional, nonmigrating, flowable colored materials, such as dyes, pigments or precolored gels therein. For example, the plants 34 could actually be "drawn" or three-dimensionally "sketched" in the gel 26 in this manner. Finally, as illustrated in FIG. 8, a series of air bubbles 40 can be formed in the gel 26 utilizing a syringe 42. In this regard, because of the consistency of the gel 26, the air bubbles 40 can easily be added to or removed from the gel 26 as desired so that the air bubbles 40 can be properly placed in the gel 26 to achieve a desired visual effect.

It is seen, therefore, that the instant invention provides a highly effective suspended animation biosphere assembly. The biosphere assembly of the instant invention crux be readily assembled by a child or an adult, and it is adapted for forming both aquatic and nonaquatic biosphere assemblies. Further, because the biosphere assembly preferably includes an imidazolidinyl urea preservative, the synthetic smectite colloidal dispersion used in the biosphere assembly can be exposed to various micro organisms which are inherently encountered during use without becoming cloudy. Further, because the smectite clay colloidal dispersion used in the biosphere assembly of the instant invention retains a gel consistency for a prolonged period of time, it is possible to rearrange the biosphere assembly at various times. Hence, it is seen that the biosphere assembly and method of the instant invention represent significant advancements in the art which have substantial commercial application.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A simulated confined suspended animation biosphere assembly comprising:

an outer housing defining a confined interior area therein which is suitable for containing a liquid and including a transparent sidewall portion for viewing said interior area;

a transparent liquid gel in said interior area for simulating an environmental medium therein said gel comprising a nontoxic inorganic clay colloidal dispersion in water; and at least one suspendable artificial action component suspended in said gel so that said action component is movable therein, said suspendable action component being adapted to simulate an actual action element which is capable of voluntary, controlled, independent, action movement and which is movably suspendable in a natural environmental medium;

said gel and said suspendable component being adapted to permit said gel to be safely handled and to permit said suspendable component to be safely movably suspended in a stationary disposition in said gel without floating upwardly or gravitating downwardly therein.

2. In the simulated confined suspended animation biosphere assembly of claim 1, said outer housing comprising an aquarium, said suspendable component comprising a simulated fish.

3. In the simulated confined suspended animation biosphere assembly of claim 1, said gel comprising a colorless gel.

4. In the simulated confined suspended animation biosphere assembly of claim 1, said gel comprising a synthetic smectite clay colloidal dispersion in water.

5. In the simulated confined suspended animation biosphere assembly of claim 4, said gel further comprising imidazolidinyl urea preservative.

6. In the simulated confined suspended animation biosphere assembly of claim 5, said gel comprising between 0.05 wt. % and 0.5 wt. % of said imidazolidinyl urea preservative.

7. In the simulated confined suspended animation biosphere assembly of claim 4, said gel comprising between 1.5 wt. % and 4.0 wt. % of said synthetic smectite clay.

* * * * *